United States Patent [19]

Naudet et al.

[11] Patent Number: 4,706,354

[45] Date of Patent: Nov. 17, 1987

[54] METHOD OF MANUFACTURING A ROOT PIVOT ASSEMBLY OF A VARIABLE INCIDENCE TURBO-MACHINE BLADE

[75] Inventors: Jacky Naudet, Bondoufle; Jacques M. P. Stenneler, Le Chatelet en Brie, both of France

[73] Assignee: Societe Nationale d'Etude et de Construction de Moteurs d'Aviation "S.N.E.C.M.A.", Paris, France

[21] Appl. No.: 868,040

[22] Filed: May 29, 1986

[30] Foreign Application Priority Data

May 29, 1985 [FR] France ..... 85 08015

[51] Int. Cl.[4] ..... B21K 3/04; B23P 15/02

[52] U.S. Cl. ..... 29/156.8 R; 29/428; 29/445; 29/525; 29/DIG. 26; 415/160; 415/161

[58] Field of Search ..... 29/156.8 R, 428, 525, 29/445, DIG. 26, 156.8 B; 415/160, 161, 162, 163, 164, 165, 166

[56] References Cited

U.S. PATENT DOCUMENTS

| | | | |
|---|---|---|---|
| 2,197,335 | 4/1940 | Bohen | 29/156.8 R |
| 3,030,072 | 4/1962 | Boyd | 415/163 |
| 3,542,484 | 11/1970 | Mason | 415/160 |
| 3,717,567 | 2/1973 | Bodine | 204/222 |
| 3,990,810 | 11/1976 | Amos et al. | 415/161 |
| 4,604,030 | 8/1986 | Naudet | 415/126 |

FOREIGN PATENT DOCUMENTS

| | | |
|---|---|---|
| 0093631 | 11/1983 | European Pat. Off. . |
| 1114241 | 5/1956 | France . |
| 1445249 | 8/1965 | France . |
| 2556410 | 6/1985 | France . |
| 807231 | 1/1959 | United Kingdom . |
| 1274808 | 5/1972 | United Kingdom . |

OTHER PUBLICATIONS

Mecanique Electricite, No. 217, Jan. 1968, "Application de L'Usinage Electrochimique (E.C.M.) Aux Aubes de Turbine", by M. O. Traynard, Chef de production S.N.E.C.M.A.

*Primary Examiner*—Howard N. Goldberg
*Assistant Examiner*—Ronald S. Wallace
*Attorney, Agent, or Firm*—Oblon, Fisher, Spivak, McClelland, & Maier

[57] ABSTRACT

A method of manufacturing a variable incidence stator blade assembly comprising forming a blade with a root which forms an extension of the aerodynamic profile of the blade, forming a bush with a recess accommodating the root by ultrasonic, electro-chemical or electro-erosion machining and assembling the blade and bush in a turbo-machine outer casing and in an inner ring of channel section.

A variable incidence stator blade assembled in a compressor of a gas turbine is also described, the blade assembly being as manufactured by the method. The channel section inner ring carried an abradable layer which co-operates to form a seal with annular lips carried by the compressor rotor drum.

5 Claims, 5 Drawing Figures

METHOD OF MANUFACTURING A ROOT PIVOT ASSEMBLY OF A VARIABLE INCIDENCE TURBO-MACHINE BLADE

BACKGROUND OF THE INVENTION

Field of the Invention

The invention relates to a method of manufacturing a root pivot assembly of blades of a turbo-machine and more particularly variable incidence stator blades of compressors for aircraft turbo-jet engines.

Background of the Prior Art

The facility of variable orientation of stator blades of the various stages of a compressor is particularly necessary if it is desired to achieve for each stage of the compressor the highest possible pressure rise at a given rating while at the same time maintaining a sufficient margin in relation to the surge region of operation. In order to enable such orientation, the blades generally comprise a tip pivot assembly cooperating with a fixed bearing in the engine casing and actuated by a control device for orientation of the blades, while the blade roots comprise a cylindrical seating which enables them to turn within a bearing disposed within an inner location point of an internal ring of the engine.

Such variable incidnece blades comprising a cylindrical root pivot rotatable within a bearing are described in particular in U.S. Pat. No. 3,990,810, in French patent specification No. 1,114,241 and in French patent application No. 83.19538 filed Dec. 7, 1983 in the name of the present applicant and published under number FR No. 2,556,410 and corresponding to U.S. Pat. No. 4,604,030, issued Aug. 5, 1986.

The manufacture of such blades requires special care since the latter being produced by casting, the mould therefor is complex to produce. On the other hand, the cylindrical seating of the root of the blade must be turned to ensure correct machining of the blade root, which constitutes a supplementary problem, both from the viewpoint of complexity as well as the time required for manufacture and the cost.

The method according to the invention has as its object to simplify the manufacture of a stator blade assembly and in particular the root of the blade with a view to reducing the cost.

A further object of the present invention is to avoid conventional machining operations of the root assemblies of blades with adjustable incidence while at the same time maintaining their facility of turning by means of a pin or peg in a locating recess of the internal ring of the engine.

A further object of the present invention is to simplify the mounting of variable incidence stator blades within the inner ring, and in particular to facilitate the adjustment in height of the blades in a receiving recess of the inner ring, while at the same time minimising the clearances resulting from machining defects or assembly defects.

Summary of the Invention

According to the present invention there is provided a method of manufacturing a turbo-machine blade assembly, the root of the blade carrying a bush enabling turning within the inner ring of the turbo-machine, the method comprising the steps of producing a blade with a blade root in the form of a prolongation of the profile of the aerodynamic portion of the blade, producing a bush including a cylindrical external seating, mounting the bush in an ultrasonic machining apparatus, applying a member subject to ultrasonic frequency vibration produced by the apparatus to the recess, the member having dimensions such that the recess is finish machined to a size such that a recess is formed which is matched to the blade root.

In carrying out this method the pin or other template may be formed either by the root of the blade itself, or by a tool of the same profile but having a size slightly smaller than that of the blade pin. Blades of which the root is made with a profile which corresponds to that of the blade itself have already been proposed in French patent specification No. 1 445 249 and British patent specification No. 807 231 but these prior specifications are only concerned with fixed stator blades, secured in slits of the inner ring without any possible control of the orientation of the stator blades and for which no rotation problem will arise for the blade about its longitudinal main axis.

Further according to the present invention there is provided a variable incidence stator blade for a turbo-machine, comprising a pivot at the tip, a pivot assembly at the root of the blade having a cross-sectional profile substantially the same as the aerodynamic portion of the blade with opposed plane faces extending transversely to the intrados and extrados, bearing means in the engine casing accommodating the tip pivot, a bush of the pivot assembly receiving the blade root having a cylindrical external profile capable of turning in an inner ring member of a turbo-machine.

Preferably, when the inner ring of the stator is disposed in the interior of an annular member incorporating fluidtight means interposed between the stator and the adjacent rotor, and if the blade root traverses the bush from one end to the other, the annular member comprises on its radially outer face an abradable material capable of compensating for clearances in the mounting of the blade provided by its bush within the inner ring and to ensure the control of the height of the blade within the ring.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DESCRIPTION OF THE PREFERRED EMBODIMENTS

Figure 1:
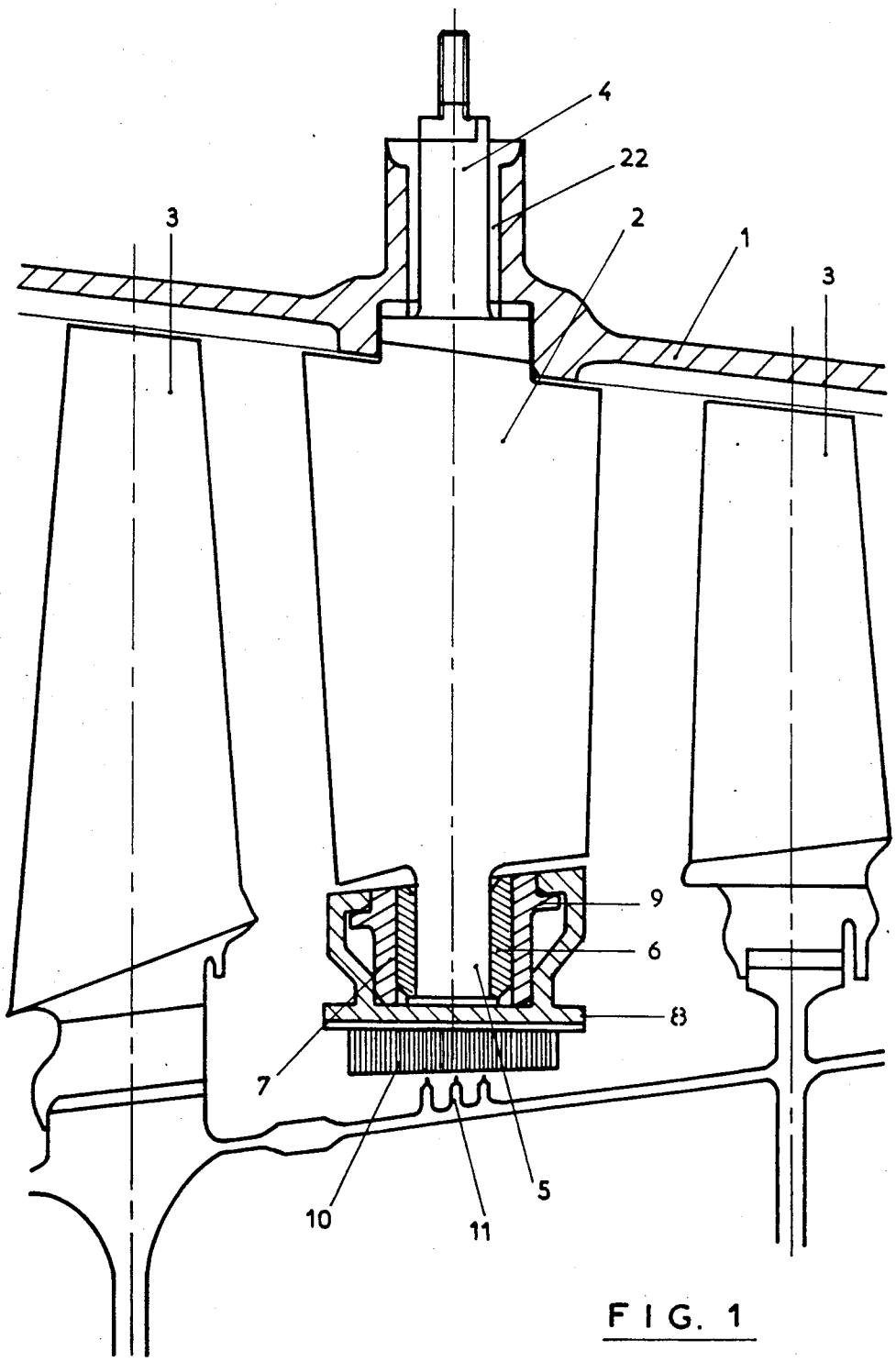
FIG. 1 is an axial sectional view of a part of a compressor of a gas turbine plant showing the connection of a blade root pivot of a variable incidence stator blade with the inner ring of the stator.
Figure 2:
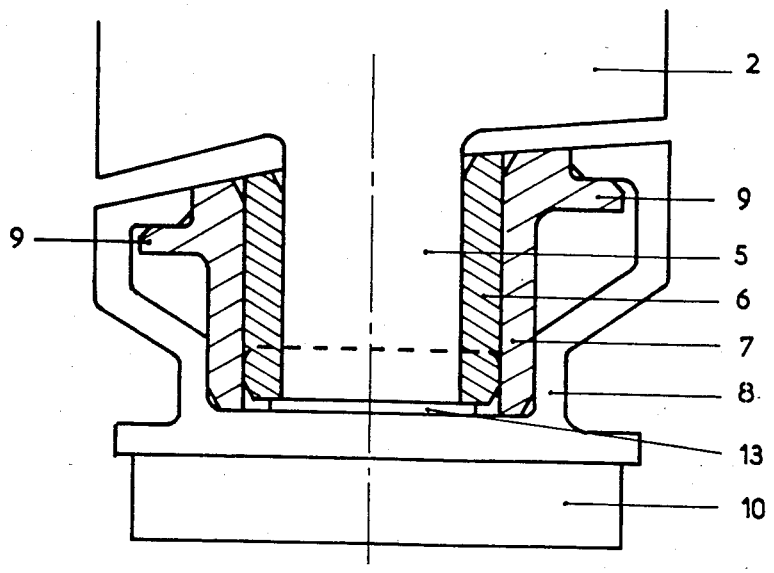
FIG. 2 illustrates, in an enlarged scale, a detailed view of the blade root assemble in accordance with the invention at the inner ring of the stator.
Figure 5:
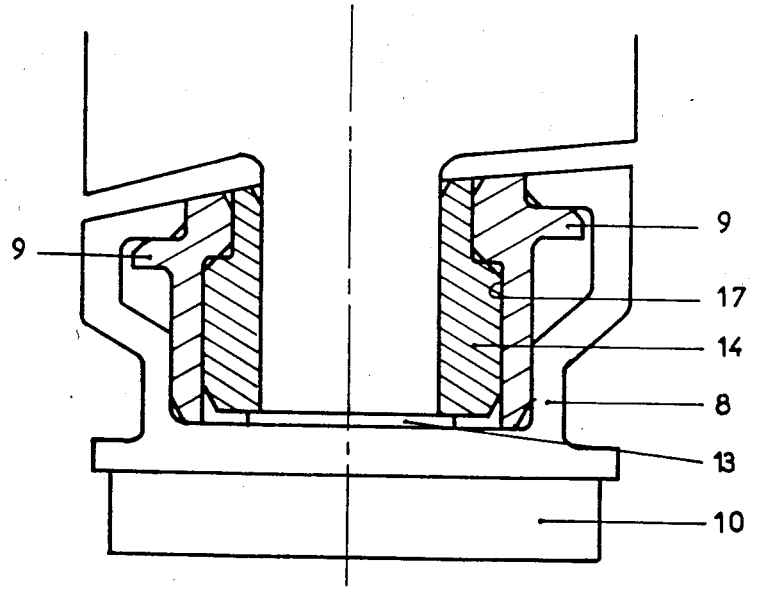
FIG. 5 shows, in a longitudinal sectional view, the blade root assembly provided with the second modification of the bush comprising security abutment means effective in the event of breakage of one of the adjustment device elements which serve for the orientation of the blades.
Figure 3:
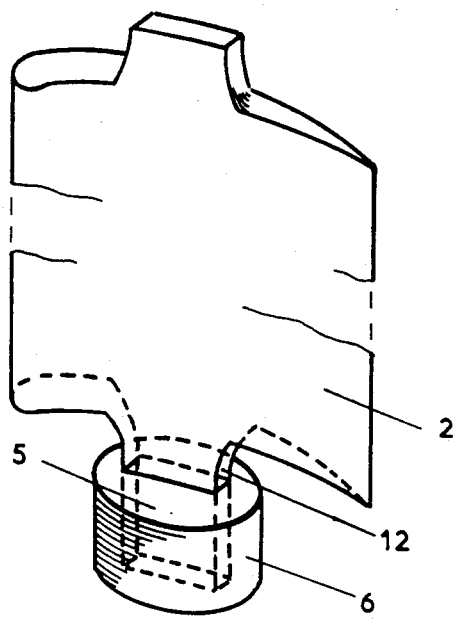
FIGS. 3 and 4 illustrate, in perspective the mounting of the blade root respectively in a first and a second modification of a bush incorporated in an assembly in accordance with the invention.
Figure 4:
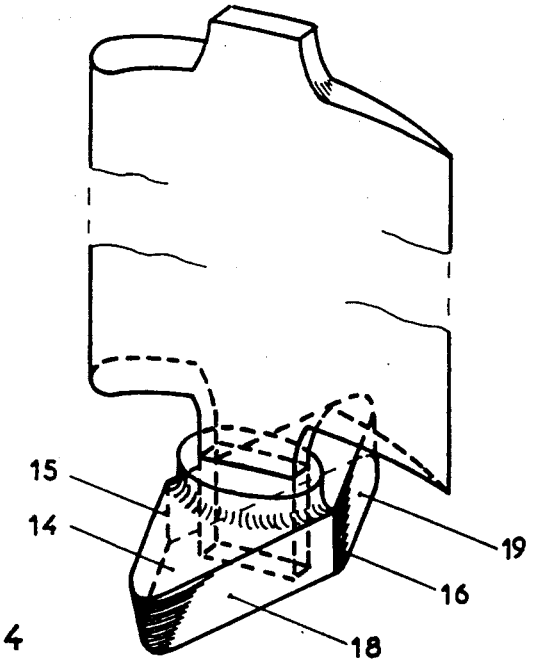

An axial section is illustrated in FIG. 1 of a portion of a compressor of a gas turbine engine. Within the casing 1, one stage of the stator separates two stages of rotor blades 3 mounted on a drum type rotor. The stator comprises a ring of blades 2 each extending radially from the casing 1 on which they are mounted for rotation about their longitudinal axes through the intermediary of a tip pivot pin 4 turning in a bearing housing rigid with the casing 1, a bush 22 being interposed between the pivot pin and the housing. The pivot is coupled with an incidence control mechanism (not shown).

At the other end thereof extending towards the axis of the engine, each blade comprises a root 5 cooperating with a recess in a bush 6, itself rotatable in a radial bore of an annular sector 7. The ring formed by the sectors 7 defines by its radially outer face, the inner wall of the main gas flow of the compressor, the sectors forming it being interconnected by a channel-section member 8 also divided into sectors. The radially outer edges of the member 8 are formed with flanges which engage corresponding lateral flanges 9 of the ring.

The channel-section member 8 serves to support a material forming a fluidtight, abradable seal 10 which cooperates in known manner with lips 11 of a labyrinth seal rigid with the rotor drum in order to limit leakages resultant from the difference in pressures existing on each side of the stator stage under consideration.

In order to provide a simple connection between the root of the blade 5 and ring 7, the casting of the blade 2 is carried out such that the root 5 has a profile which is a prolongation of the profile of the blade itself and of which the faces 12 transverse to the intrados and extrados are parallel. In parallel with this operation, the bush intended to cooperate both with the blade root 5 and with the ring 7 is partly formed.

The external shapes are then machined in a known manner either to provide a simple cylindrical seating, or in a modification explained hereinafter, to provide a base of losenge or rhomboidal form intended to provide a security stop function in case of failure of the blade orientation adjustment device.

The blank of the bush thus produced is then disposed vertically in the chuck of an ultra-sonic machining tool and is used as the machining template of the recess of the bush. The root 5 of the blade itself is subjected to ultra-sonic frequency vibration and is also subjected the vertical movement as it is forced into the preformed recess in the bush.

The ultra-sonic machining of the bush 6 is continued until the bore extends to the lower part of the bush. Preferably, an automotive lubricating material is used for the material of the bush 6 such as carbon or graphite.

By using the blade root itself as the template for machining of the recess in the bush, a recess is produced of which the sides will be slightly larger than those of the blade root, having regard for machining tolerances by ultra-sonic means between the root and its matrix. If a fit is required which is tighter between the blade root and the bush when assembled, it is possible to use for machining of the bush recess a member of the same profile as the blade root to be assembled but with slightly smaller cross-sectional dimensions.

When material selected for the bush cannot be machined by ultra-sonic means, the machining of the recess can be effected by electro-chemical machining or by electro-erosion. However, for a carbon or graphite bush, machining by ultra-sonics will be preferred because of its high speed. Thus, the time required for carrying out the final formation of the recess of the bush by ultra-sonics will not normally exceed about twelve seconds.

The novel application of the method, known per se of machining by ultra-sonics for the production of stator blade assemblies with variable incidence constitutes substantial progress in the manufacture of turbo-machine blades of this type because it enables the use of rough cast blades without any auxiliary operation of machining of the blade root in order to produce with the bush, an assembly for rotation in the stator inner ring, the pivot assembly of the blade root thus being provided by the blade root together with the bush.

The invention also relates to a turbo-machine variable incidence stator blade with a root in the form of an extension of the aerodynamic blade profile, defined at its faces transverse to the intrados and extrados by parallel surfaces 12 cooperating with the bush of which the recess is machined by ultra-sonics in accordance with the method hereinbefore described.

A blade of this type assembled to its bush is intended to be rotatably adjustable in a recess formed by a circumferential groove 17 of the inner ring 7 of the stator, the ring being disposed within the interior of a circular channel-section member 8. If the blade root 5 traverses the bush 6 from end to end, the member 8 carries on its radially inner face, an abradable material layer 13 intended to compensate for manufacturing tolerances by mounting it between the blade root 5 assembled with its bush 6, on the one hand and the member 8 on the other hand, such tolerances being the result of a range in the lengths of the blade roots owing to manufacturing tolerances, of a radial dimension range in the mounting of the blades on the angular adjustment control device or of defects in the circularity of the ring 7 and in particular of its flanges 9. The abradable layer 13 also enables, by proper calculation of its thickness, suitable adjustment in height of the blade within the ring 7.

When the root 5 does not traverse the bush 6 (non-illustrated modification), taking up of the tolerances is effected as disclosed in French patent application No. 83.19538 in the name of the present applicant and corresponding to U.S. Pat. No. 4,604,030. The bush then includes an outer screw-thread cooperating with a complementary tapping in the recess of the annular sector, such that the bush, being in contact against the radially inner face of the platform of the corresponding blade, enables radial displacement of the blade produced by rotation of the bush in its recess.

According to a modification the bush 6 may conclude abutment means preventing the blade 2 from fluttering like a flag, which can give rise to surging of the whole stage, if one of the elements of the orientation adjustment mechanism of the blades should fail. The bush 6 comprises an enlargement 14 having in section the form of a losenge or rhombus of which the apices 15,16 lying on the smaller diagonal are rounded. The ring 7 then comprises a circumferential groove 17 of width slightly larger than the smaller diagonal of the enlargement 14.

In normal operation, the bush 6 is in contact by the rounded apices 15,16 with opposed faces of the groove 17.

In the case of failure of one of the orientation control elements, forced rotation of the blade and of the pivot in its groove, is prevented when the faces 18 and/or 19 contact the opposed faces of the groove 17.

The orientation of the recess in the bush can be calculated relative to the smaller diagonal of the enlargement such that even in the case of failure of the orientation control mechanism, that is to say when the faces 18 or 19 of the enlargement contact the groove 17, the orientation of the blade remains compatible with substantially correct operation of the stator stage.

Because of the ease of carrying out the invention, there is an overall simplification in the production of blades with variable incidence together with their securing devices. This results in a substantial reduction in the time and cost of manufacture, which makes the method especially suitable for the manufacture of aircraft turbo-jet engine blades.

Obviously, numerous modifications and variations of the present invention are possible in light of the above teachings. It is therefore to be understood that within the scope of the appended claims, the invention may be practiced otherwise than as specifically described herein.

We claim:

1. A method of manufacturing a turbo-machine blade assembly, the root of the blade carrying a bush enabling turning within the inner ring of the turbo-machine, the method comprising the steps of:

producing a blade with a blade root in the form of a prolongation of the profile of the aerodynamic portion of the blade, producing a bush including a cylindrical external seating, mounting the bush in an ultrasonic machining apparatus, and applying a member subject to ultrasonic frequency vibration produced by the apparatus to the bush to form a recess in said bush, the member having dimensions such that the recess is finish machined to a size matched to the blade root.

2. A method of manufacture according to claim 1 wherein the blade root itself is used as the machining member subjected to ultrasonic vibration, the internal recess of the bush being produced by pressure of the root of the blade on the bush.

3. A method of manufactur according to claim 1 wherein the said ultrasonic machining member takes the form of a tool of which the section has one side slightly smaller than that of the corresponding side of the root of the blade.

4. A method of manufacturing a turbo-machine blade assembly, the root of the blade carrying a bush enabling turning within the inner ring of the turbo-machine, the method comprising the steps of:

producing a blade with a blade root in the form of a prolongation of the profile of the aerodynamic portion of the blade, producing a bush including a cylindrical external seating, mounting the bush in an electro-erosion apparatus, and applying a member subject to electro-erosion produced by the apparatus to the bush to form a recess in said bush, the member having dimensions such that the recess is finish machined to a size matched to the blade root.

5. A method of manufacturing a turbo-machine blade assembly, the root of the blade carrying a bush enabling turning within the inner ring of the turbo-machine, the method comprising the steps of:

producing a blade with a blade root in the form of a prolongation of the profile of the aerodynamic portion of the blade, producing a bush including a cylindrical external seating, mounting the bush in an electro-chemical apparatus, and applying a member subject to electro-chemical machining produced by the apparatus to the bush to form a recess in said bush the member having dimensions such that the recess is finish machined to a size matched to the blade root.

* * * * *